US010023274B1

(12) United States Patent
George, II et al.

(10) Patent No.: US 10,023,274 B1
(45) Date of Patent: Jul. 17, 2018

(54) WATER PAD ASSEMBLY

(71) Applicants: Daniel C. George, II, Grand Rapids, MI (US); Matthew Jung, Grand Rapids, MI (US)

(72) Inventors: Daniel C. George, II, Grand Rapids, MI (US); Matthew Jung, Grand Rapids, MI (US)

(73) Assignee: Comfort Research, LLC, Grand Rapids, MI (US)

( * ) Notice: Subject to any disclaimer, the term of this patent is extended or adjusted under 35 U.S.C. 154(b) by 0 days.

(21) Appl. No.: 15/241,250

(22) Filed: Aug. 19, 2016

Related U.S. Application Data

(60) Provisional application No. 62/206,892, filed on Aug. 19, 2015.

(51) Int. Cl.
*B63B 35/58* (2006.01)
*B63B 35/73* (2006.01)
*A47C 15/00* (2006.01)

(52) U.S. Cl.
CPC ..... *B63B 35/58* (2013.01); *A47C 15/006* (2013.01); *B63B 35/73* (2013.01); *B63B 2231/40* (2013.01); *B63B 2231/44* (2013.01)

(58) Field of Classification Search
CPC ..... B63B 35/58; B63B 35/73; B63B 35/74; B63B 35/76; B63C 9/08; A47C 15/006
USPC ..... D21/803, 809; 441/35, 40, 129–132
See application file for complete search history.

(56) References Cited

U.S. PATENT DOCUMENTS 3,808,616 A * 5/1974 White ..... A47C 1/146 297/377
4,021,380 A * 5/1977 Nuttall ..... C08J 9/0066 264/54
4,650,432 A * 3/1987 Sainsbury ..... B63B 35/58 114/345
4,662,851 A * 5/1987 Foster ..... B63C 9/08 441/129
5,226,184 A * 7/1993 Cheng ..... B63B 35/76 441/125
5,439,405 A * 8/1995 Storey ..... A45C 9/00 441/126
5,779,513 A * 7/1998 Burton ..... B63B 35/74 441/129
6,062,930 A * 5/2000 Smith ..... A47C 15/006 441/125
7,335,079 B1 * 2/2008 Darling ..... B63C 9/082 441/129
7,744,436 B2 * 6/2010 Pole, III ..... B63B 35/34 441/129
9,775,439 B2 * 10/2017 Rubey ..... A47C 4/28

* cited by examiner

*Primary Examiner* — Ajay Vasudeva
(74) *Attorney, Agent, or Firm* — King & Partners, PLC

(57) ABSTRACT

A water pad assembly adapted to floatingly support a human in open water, including: a water pad member and a plurality of grommets and/or cup holders.

1 Claim, 13 Drawing Sheets

WATER PAD ASSEMBLY

CROSS-REFERENCE TO RELATED APPLICATIONS

This application claims the benefit of U.S. Provisional Application Ser. No. 62/206,892, filed Aug. 19, 2015, entitled "WATER PAD ASSEMBLY," which is hereby incorporated herein by reference in its entirety—including all references and appendices cited therein.

BACKGROUND OF THE INVENTION

1. Field of the Invention

The present invention relates in general to water pad assemblies and, more particularly, to water pad assemblies comprising a plurality of grommets, grommet pads, cup holders, and/or living hinges.

2. Background Art

Furniture assemblies, pads, and their coatings, covers, and accessories have been known in the art for years and are the subject of a plurality of patents and publications, including: U.S. Pat. No. 6,725,482 entitled "Frameless Chair," U.S. Pat. No. 6,279,184 entitled "Frameless Chair," United States Patent Application Publication Number 2003/0066268 entitled "Process for Packaging a Polyurethane Foam Filled Article of Furniture," U.S. Pat. No. 7,735,931 entitled "Portable Chair Apparatus," U.S. Pat. No. 7,571,965 entitled "Molded Foam Pool Chair," U.S. Pat. No. 7,273,251 entitled "Video Game Chair," U.S. Pat. No. 6,997,509 entitled "Juvenile Seat Cup Holder," U.S. Pat. No. 5,213,394 entitled "Molded Recliner Rocker Chair," U.S. Pat. No. 5,004,296 entitled "Floating Lounge Chair," U.S. Pat. No. 4,964,600 entitled "Insulated Cup Holder With Flexible Base Member," U.S. Pat. No. 4,662,852 entitled "Floating, Reclining Lounge Mechanism," U.S. Pat. No. 4,564,240 entitled "Lounger or Reclining Chair Made From a Floatable Plastic Body," United States Patent Application Publication Number 2007/0257530 entitled "Video Game Chair," and United States Patent Application Publication Number 2005/0242643 entitled "Ergonomic Rocker"—all of which are hereby incorporated herein by reference in their entirety including the references cited therein.

While the above-identified patents and publications do appear to disclose furniture assemblies and pads, their configurations remain non-desirous and/or problematic inasmuch as, among other things, none of the above-identified furniture assemblies appear to be readily adaptable for use as a water pad. Moreover, none of the above-identified assemblies appear to disclose water pad assemblies comprising a plurality of grommets, grommet pads, cup holders, and/or living hinges.

It is therefore an object of the present invention to provide a water pad assembly comprising a plurality of grommets, grommet pads, cup holders, and/or living hinges.

These and other objects of the present invention will become apparent in light of the present specification, claims, and drawings.

SUMMARY OF THE INVENTION

The present invention is directed to, in one embodiment, a water pad assembly adapted to floatingly support a human in open water comprising: a water pad member and a plurality of grommets and/or cup holders.

In a preferred embodiment of the present invention, the water pad assembly comprises one or more grommet pads, which reinforce the structural integrity of the water pad proximate a grommet.

In another preferred embodiment of the present invention, the water pad assembly comprises one or more living hinges that facilitate converting the water pad from a open/deployed configuration to a closed/storage configuration, and vice versa.

In yet another preferred embodiment of the present invention, the water pad member is fabricated from a material selected from the group consisting of a natural polymeric resin, a synthetic polymeric resin, poly(ethylene vinyl acetate) (EVA), cross-linked poly(ethylene vinyl acetate) (X-EVA), polystyrene, polyethylene, polypropylene, expanded polypropylene, polyurethane, bark, cork, and combinations thereof. A protectant may also be associated with the water pad assembly that comprises conventional paint, and/or a flexible, rubber type coating, such as Plasti Dip (e.g., heptane, xylene, and aliphatic hydrocarbons, etcetera).

In another preferred embodiment of the present invention, the cross-linked poly(ethylene vinyl acetate) comprises a density ranging from approximately 0.5 g/cm$^3$ to approximately 2.0 g/cm$^3$, and more preferably comprises a density ranging from approximately 0.8 g/cm$^3$ to approximately 1.3 g/cm$^3$.

In a preferred embodiment of the present invention, a coating is applied to at least a portion of an outer surface of the water pad member. In this embodiment the coating preferably comprises a material selected from the group consisting of an elastomer, a saturated rubber, an unsaturated rubber, polyurea, vinyl, polyvinylchloride, and combinations thereof.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

DETAILED DESCRIPTION OF THE INVENTION

Figure 1:
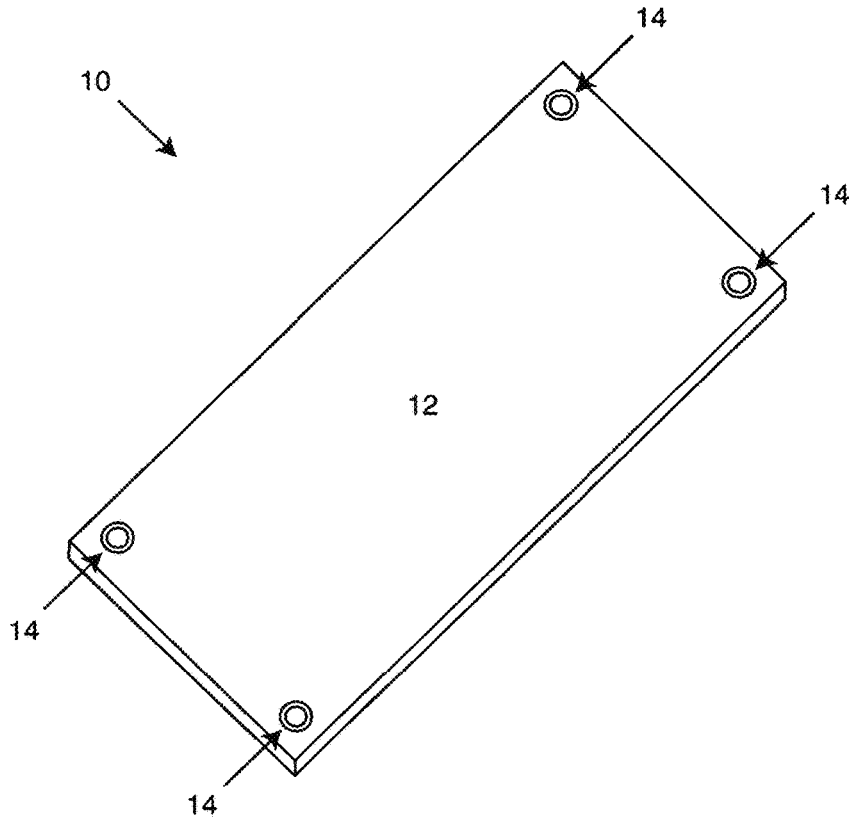
FIGS. 1-13 of the drawings provided herein show a plurality of embodiments of water pad assemblies, as well as associated features and accessory items.
Figure 2:
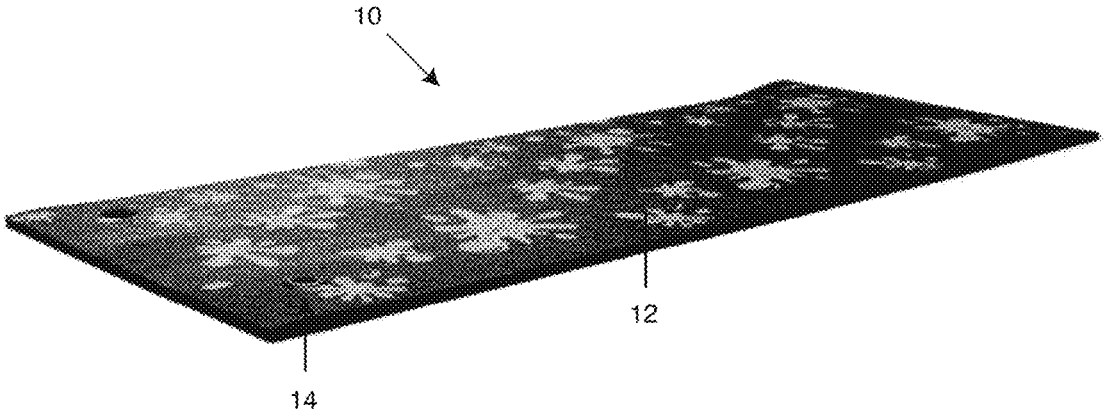
Figure 2:
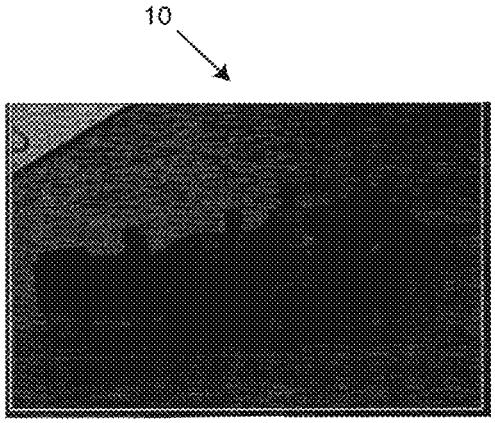
Figure 3:
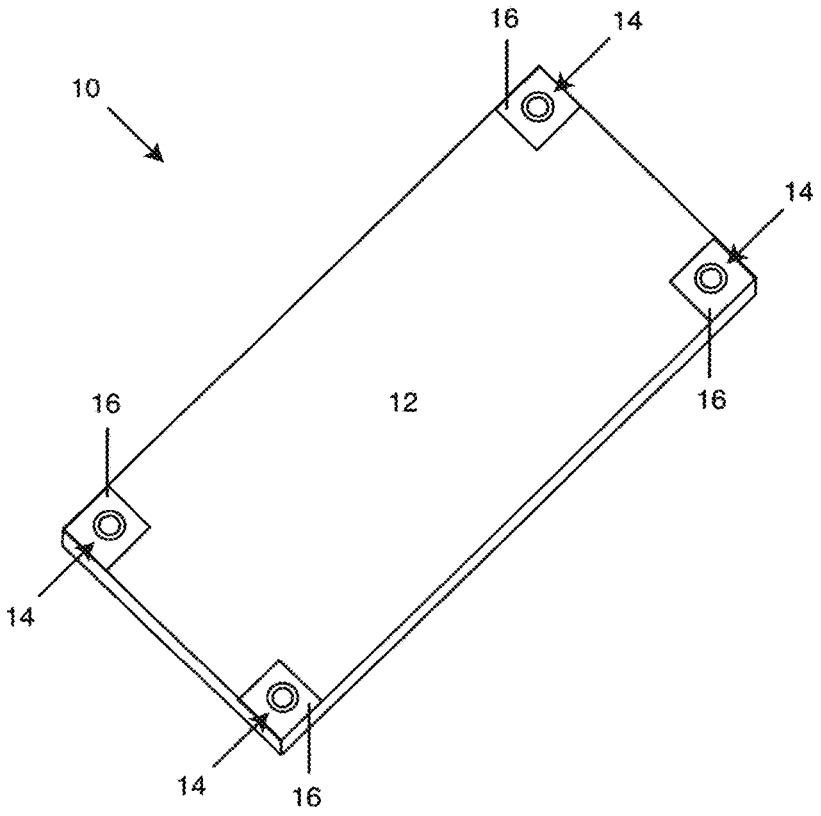

While this invention is susceptible of embodiment in many different forms, there is shown in the drawings and will be described herein in detail, one or more specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to FIGS. 1-13, a water pad assembly 10 is adapted to floatingly support a human in open water, comprising: a water pad member 12, a plurality of grommets 14 and cup holders 15. In accordance with the present invention, a plurality of grommets 14 and cup holders 15 are suitable for use including, but not limited to, those disclosed in FIGS. 8-13.

In a preferred embodiment of the present invention, water pad assembly 10 comprises one or more grommet pads 16, which reinforce the structural integrity of water pad member 12 proximate grommet 14. Grommet pad 16 is preferably fabricated from natural and/or synthetic rubbers, plastics, etcetera.

Figure 4:
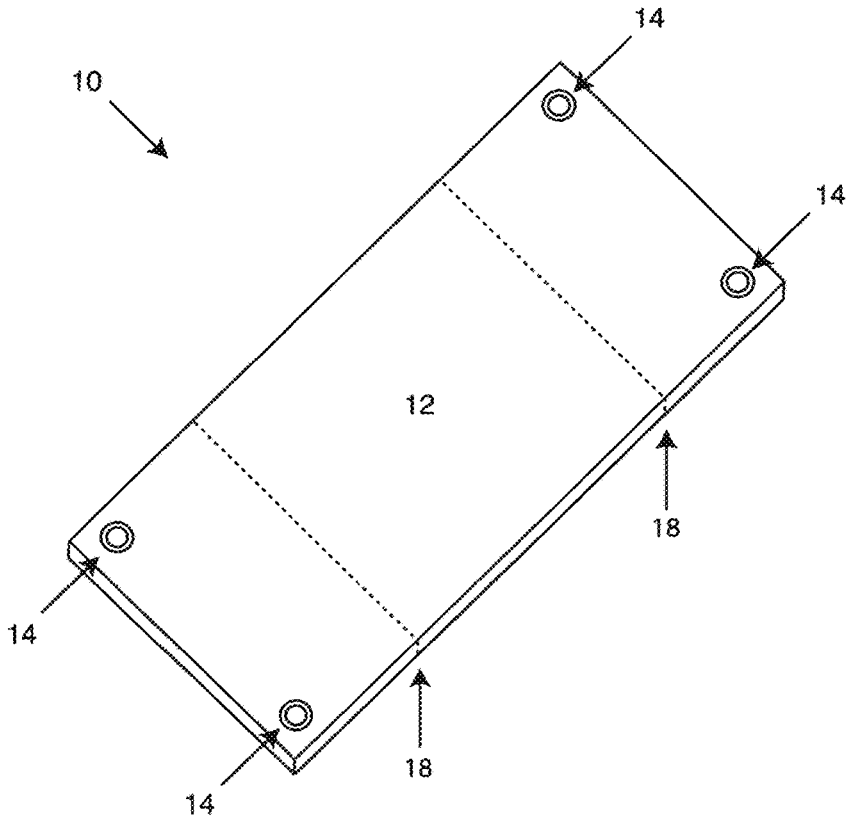
Figure 5:
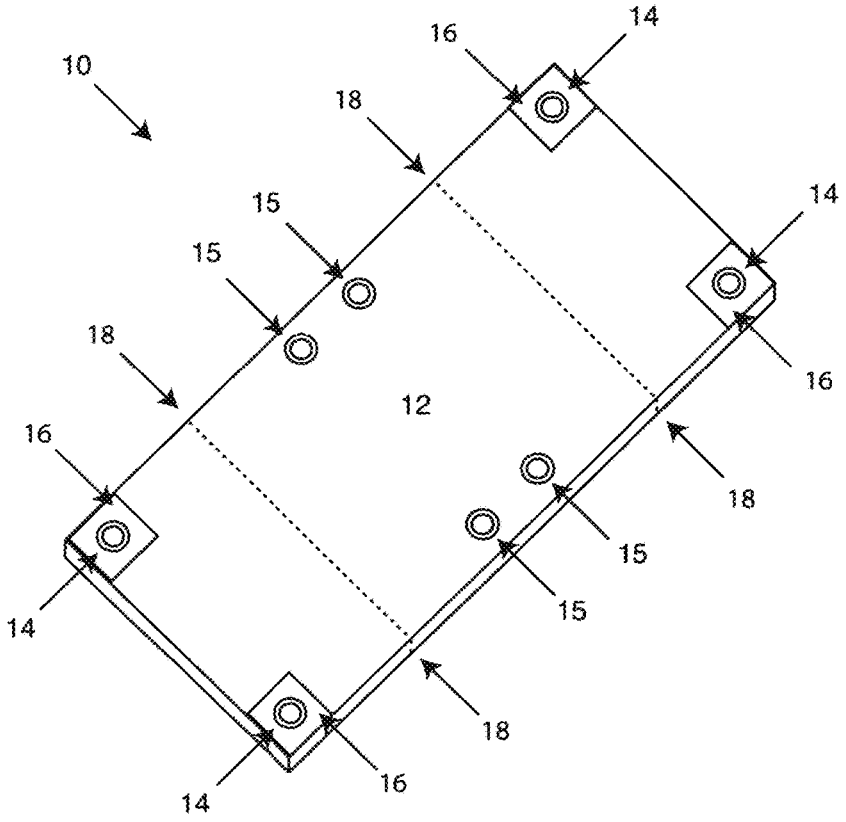
Figure 6:
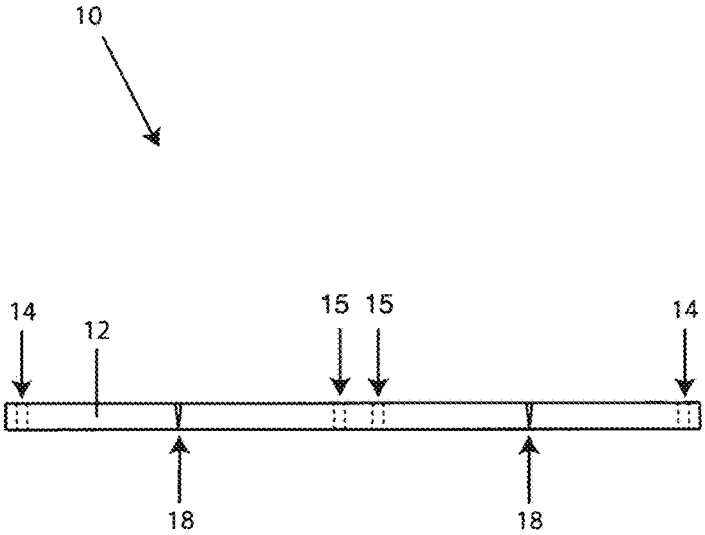
Figure 7:
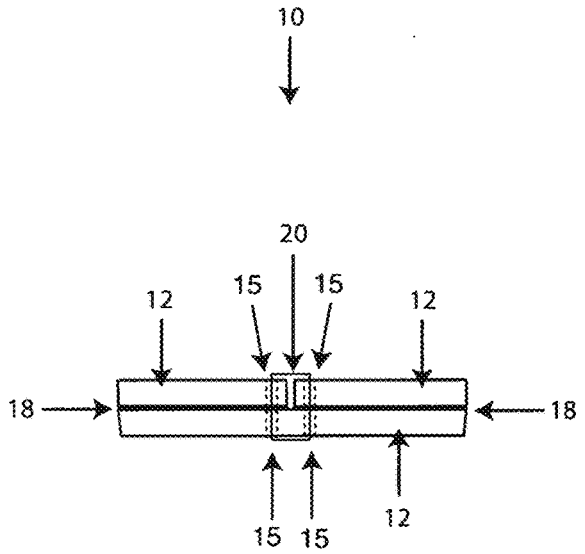
Figure 8:
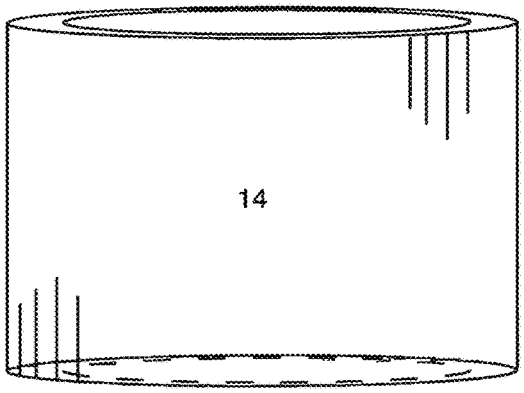
Figure 9:
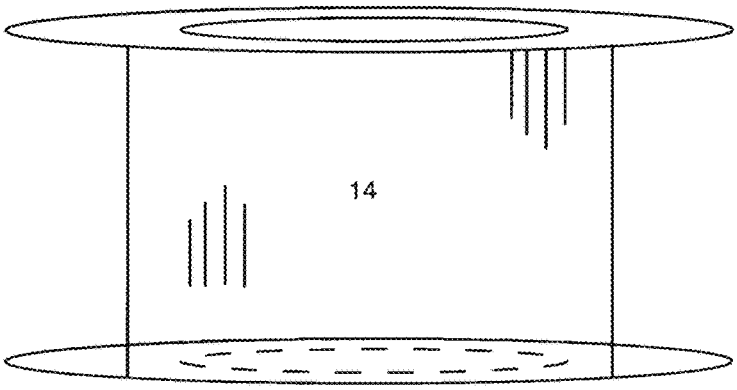
Figure 10:
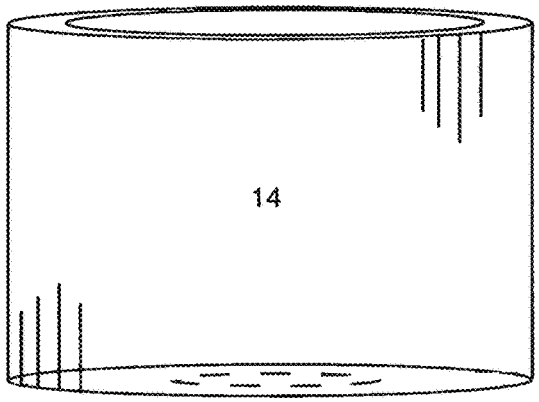
Figure 11:
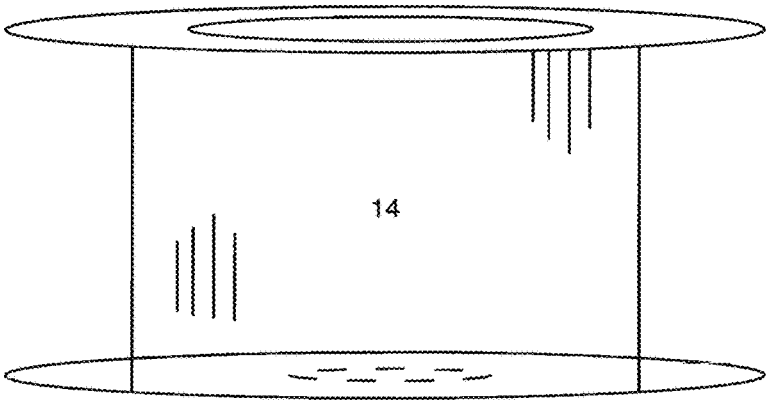
Figure 12:
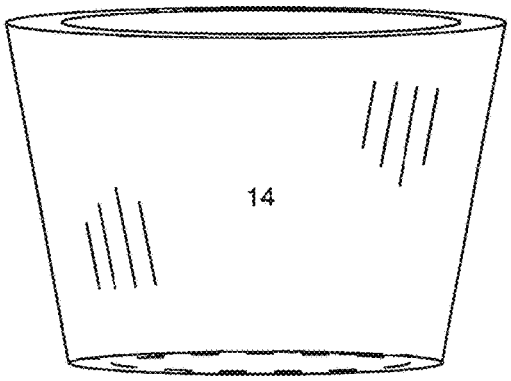
Figure 13:
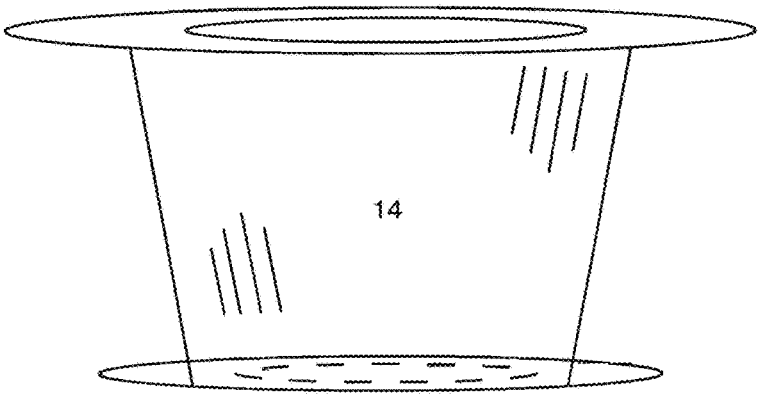

In the preferred embodiment of the invention shown in FIGS. 4-7, water pad assembly 10 has a substantially rectangular shape and comprises a middle flotation member and two side flotation members, the two side flotation members being substantially smaller in size than the middle flotation member. The two side flotation members are movably attached at opposing sides of the middle member by living hinges 18, which allows the water pad assembly 10 to be converted between an extended deployed configuration and a compactly folded storage configuration. When the water pad assembly 10 is in the extended deployed configuration as shown in FIGS. 4-6, the middle flotation member and the side flotation members are substantially planar. When the water pad assembly 10 is in the compactly folded storage configuration as shown in FIG. 7, the side members are folded over a surface of the middle flotation member. As seen in FIGS. 4 and 5, the middle flotation member comprises cup holders 15, and the two side flotation members comprise a plurality of grommets 14 and grommet pads 16 at the outer corners. The grommet pads 16 reinforce the structural integrity of the water pad assembly 10 proximate the grommets 14. As further seen in FIG. 6, the grommets 14 and the cup holders 15 extend through the water pad assembly 10. A rope or cord 20 (e.g., elastic and/or non-elastic) is preferably provided to finalize securement while in a closed/storage configuration.

In yet another preferred embodiment of the present invention, the water pad member is fabricated from a material selected from the group consisting of a natural polymeric resin, a synthetic polymeric resin, poly(ethylene vinyl acetate) (EVA), cross-linked poly(ethylene vinyl acetate) (X-EVA), polystyrene, polyethylene, polypropylene, expanded polypropylene, polyurethane, bark, cork, and combinations thereof. A protectant may also be associated with the water pad assembly that comprises conventional paint, and/or a flexible, rubber type coating, such as Plasti Dip (e.g., heptane, xylene, and aliphatic hydrocarbons, etcetera).

In another preferred embodiment of the present invention, the cross-linked poly(ethylene vinyl acetate) comprises a density ranging from approximately 0.5 g/cm$^3$ to approximately 2.0 g/cm$^3$, and more preferably comprises a density ranging from approximately 0.8 g/cm$^3$ to approximately 1.3 g/cm$^3$.

In a preferred embodiment of the present invention, a coating is applied to at least a portion of an outer surface of the water pad member. In this embodiment the coating preferably comprises a material selected from the group consisting of an elastomer, a saturated rubber, an unsaturated rubber, polyurea, vinyl, polyvinylchloride, and combinations thereof.

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A buoyant water pad assembly configured to support a human user on a body of water, comprising:

a substantially rectangular flotation pad member comprising a middle flotation member and two side flotation members, wherein the two side flotation members are substantially smaller in size than the middle flotation member, the two side flotation members each movably attached at opposing sides of the middle member by at least one living hinge to allow the side members to be folded relative to the middle flotation member, thereby allowing the flotation pad member to be converted between an extended deployed configuration in which the middle flotation member and the side flotation members are substantially planar and a compactly folded storage configuration in which the side members are folded over the middle flotation member, the two side flotation members each comprising a plurality of grommets disposed on outer corners and extending through the side flotation members, the side flotation members further comprising grommet pads at the outer corners to reinforce the structural integrity of the side flotation members proximate the grommets, the middle flotation member comprising cup holders extending through the middle flotation member, wherein the flotation pad member has a core fabricated from cross-linked poly(ethylene vinyl acetate) having a density ranging from 0.5 g/cm$^3$ to 2.0 g/cm$^3$, and wherein a coating is applied on at least a portion of an outer surface of the flotation pad member, wherein the coating comprises an elastomer.

* * * * *